United States Patent [19]

Sato et al.

[11] Patent Number: 4,846,252

[45] Date of Patent: Jul. 11, 1989

[54] SECONDARY PRESSURIZATION CASTING METHOD

[75] Inventors: Masakazu Sato; Keisuke Ban; Bakugo Fujito, all of Utsunomiya; Michio Konishi, Wako, all of Japan

[73] Assignees: Honda Giken Kogyo Kabushiki Kaisha; Kabushiki Kaisha Teisan Industries, both of Tokyo, Japan

[21] Appl. No.: 236,394

[22] Filed: Aug. 23, 1988

[30] Foreign Application Priority Data

Aug. 24, 1987 [JP] Japan ..... 62-208089

[51] Int. Cl.[4] ..... B22D 18/02; B22D 27/11

[52] U.S. Cl. ..... 164/120; 164/319

[58] Field of Search ..... 164/120, 131, 347, 319, 164/320

[56] References Cited

U.S. PATENT DOCUMENTS 3,106,002 10/1963 Bauer ..... 164/120

FOREIGN PATENT DOCUMENTS 48-7570 3/1973 Japan .

49-36093 9/1974 Japan .

*Primary Examiner*—Kuang Y. Lin

*Attorney, Agent, or Firm*—Armstrong, Nikaido, Marmelstein, Kubovcik & Murray

[57] ABSTRACT

A secondary pressurization casting method, in which molten metal is injected into and filled in a cavity of a mold and then a secondary pressurizing force is exerted upon the filled molten metal by making a secondary pressurization pin advance within a through-hole formed in the wall of the mold. After commencement of filling of the molten metal in the cavity, the secondary pressurization pin placed at an initial set position is once retreated, and subsequently it is made to advance to pressurize the molten metal. A casting fin produced around the outer circumference of the tip end of the secondary pressurization pin during the period when the molten metal is being injected and filled, is integrated with the molten metal entered into the through-hole as a result of the retreat of the secondary pressurization pin, and subsequently it is pushed into the cavity by the secondary pressurization pin. Accordingly, it would never occur that the movement of the secondary pressurization pin is prevented by a wedge effect of a casting film.

5 Claims, 3 Drawing Sheets

SECONDARY PRESSURIZATION CASTING METHOD

BACKGROUND OF THE INVENTION

The present invention relates to a secondary pressurization casting method, in which molten metal is injected into and filled in a cavity of a mold, and a secondary pressurizing force is exerted upon the filled molten metal by forwardly moving a secondary pressurization pin penetrating through the wall of the mold.

A die casting method in which molten metal is poured into a cavity of a mold at a high pressure, has been widely employed and practiced as a method most suitable for mass-production in the casting technique for aluminum alloys. In this die casting method, blow holes are liable to be produced in a thick wall portion of a product, and there is a tendency that a crystalline structure would become coarse and a mechanical strength of the thick wall portion would be lowered.

In order to resolve this problem, a secondary pressurization casting method, in which an additional pressurizing force (a secondary pressurizing force) is applied to molten metal injected into and filled in a cavity of a mold, was proposed (for example, see Japanese Patent Publication No. 48-7570 (1973) and Japanese Patent Publication No. 49-36093 (1974)).

As the method for carrying out the secondary pressurization, a method of pushing a secondary pressurization pin into molten metal after completion of filling of molten metal, and a method of forwardly moving a secondary pressurization pin within a through-hole that is formed in a mold for the purpose of making the secondary pressurization pin advance or retreat and thereby pushing back the molten metal entering into the through-hole, are known.

In the die casting method, during the period when molten metal is being injected into and filled in a cavity, a pressure of several ten kgf/cm$^2$ is exerted upon the cavity wall surface, and upon completion of filling, this pressure would reach even a pressure of several hundreds kgf/cm$^2$. This molten metal pressurized to such a high pressure would enter even into minute gaps in the mold, and would form casting fins. Therefore, a casting fin is produced at the periphery of the tip end of a secondary pressurization pin inserted into a through-hole that is formed in a mold with a minute gap retained therearound. This casting fin would prevent the movement of the secondary pressurization pin due to a wedge effect, and in the worst case the secondary pressurization pin would be locked and would become unable to move.

SUMMARY OF THE INVENTION

The present invention has been worked out under the above-described technical background, and it is one object of the present invention to eliminate harms caused by a casting fin produced along the periphery of the tip end portion of the secondary pressurization pin and to smoothen the movement of the secondary pressurization pin in the secondary pressurization casting method.

The above-mentioned object can be achieved by once retreating the secondary pressurization pin placed at an initial set position after the moment of completion of filling of molten metal in a cavity and subsequently making it advance to pressurize the molten metal.

The molten metal having entered into a through-hole around the tip end portion of the secondary pressurization pin, would solidify momentarily during the period when the molten metal is injected into and filled in a cavity. Thereafter, if the secondary pressurization pin placed at the initial set position is once retreated, then the molten metal at a high pressure would flow towards the deep portion of the through-hole, following the secondary pressurization pin. At this time, already there exists a solidified annular casting fin along the inner circumference of the through-hole, hence the molten metal which subsequently flows towards the deep portion of the through-hole would fill the inside of the annular casting fin, and would quickly solidify into a lumpy body integrated with the casting fin. The lumpy body filling the whole of the opening portion of the through-hole is pushed into the molten metal that is just being solidified within the cavity, by the subsequently advancing secondary pressurization pin. Accordingly, the wedge effect caused by the casting fin would not be generated, and smooth movement of the secondary pressurization pin can be insured.

DESCRIPTION OF THE PREFERRED EMBODIMENTS

In the following, the present invention will be described in connection to one preferred embodiment thereof.

Figure 1:
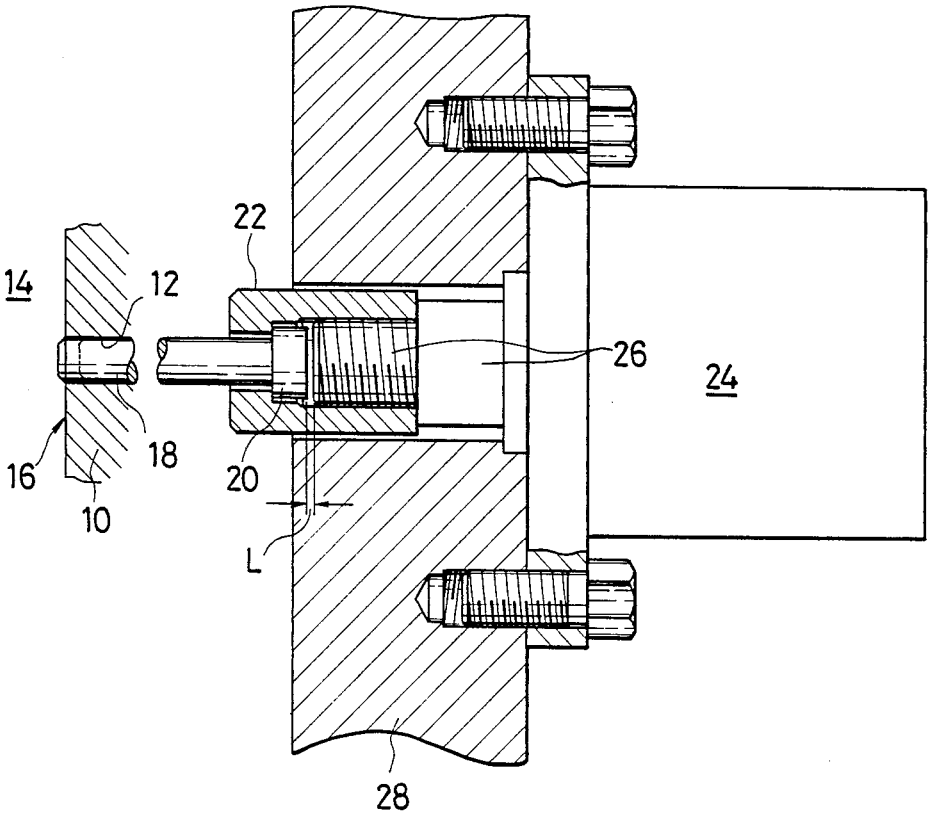
FIG. 1 is a partial cross-section view showing an essential part of a secondary pressurization casting apparatus.

FIG. 1 shows a secondary pressurization pin 18, which is inserted in a through-hole 12 formed in a mold 10 so as to be able to freely advance or retreat and which is adapted to be driven by a secondary pressurization hydraulic cylinder 24 that is fixed on a base body 28. The secondary pressurization pin 18 is coupled at its base portion 20 to a piston rod 26 of the secondary pressurization hydraulic cylinder 24 by the intermediary of a joint cylinder 22, and in the illustrated state a small gap distance (L=0.2–2.0 mm) is present between the secondary pressurization pin 18 and the piston rod 26. This small gap distance would disappear when the secondary pressurization pin 18 advances as pushed by the piston rod 26 as a result of the operation of the secondary pressurization hydraulic cylinder 24. However, after finishment of the secondary pressurization, or during the period when a mold releasing agent is applied to the mold, the secondary pressrization pin is kept projected from the mold, and thereafter when the secondary pressurization pin 18 is retreated within the through-hole 12 by retreating piston rod 26, the small gap distance L is produced. More particularly, the sizes of the joint cylinder 22 are selected so that such a small gap distance may be produced as a result of the coupling relation between the secondary pressurization pin 18 and the piston rod 26 by the intermediary of the joint cylinder 22.

The secondary pressurization pin 18 is fitted and inserted in the through-hole 12 formed in the mold 10 with a small clearance left therebetween, and in the state shown (by solid lines) in FIG. 1, where the pin 18 has retreated into the through-hole 12, the tip end of the pin 18 would slightly project from the wall 16 of the cavity 14.

Figure 2:
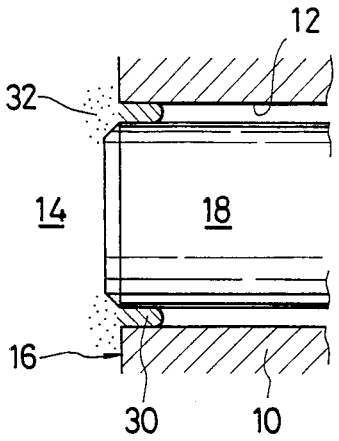
FIG. 2 is an enlarged partial view of a further essential part in FIG. 1 showing the state where a secondary pressurization pin is placed at an initial set position.
Figure 4:
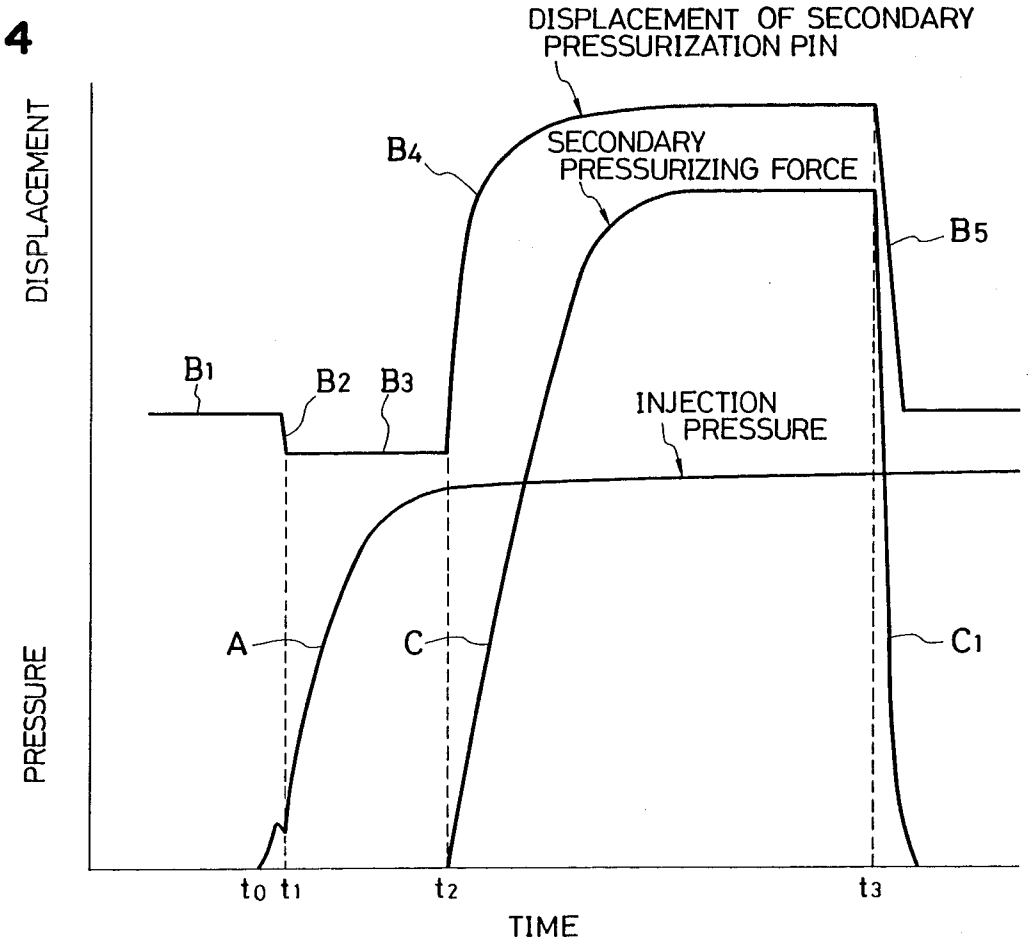
FIG. 4 is a diagram showing a variation of an injection pressure, a displacement of the secondary pressurization pin and a variation of a secondary pressurizing force.

Injection and filling of molten metal into a cavity 14 are commenced under such condition, and an injection pressure within the cavity 14 would change as shown by curve A in FIG. 4. The molten metal injected into the cavity 14 during the period from an injection start point ($t_0$) until a molten metal filling finish point, enters the through-hole 12 around the tip, end portion of the secondary pressurization pin 18, and an annular casting fin 30 is produced (FIG. 2). The position of the secondary pressurization pin 18 (the position of its tip end) is repressented by line $B_1$ that is parallel to the abscissa in FIG. 4.

Figure 3:
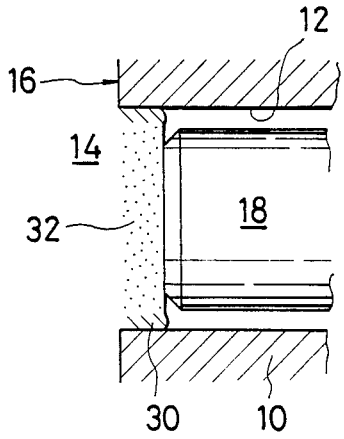
FIG. 3 is an enlarged partial view similar to FIG. 2 but showing the state where the secondary pressurization pin has retreated from the initial set position.

While the molten metal is being injected and filled in the cavity 14, the secondary pressurization pin 18 is pushed by the injection pressure of the molten metal and it retreats by the above-mentioned small gap distance (L) (See the double-dot chain line in FIG. 1 and line $B_2$ in FIG. 4). This retreat start point is somewhat earlier than the time point ($t_1$) of completion of filling of molten metal in the cavity 14, and it is desirable that the retreat of the secondary pressurization pin 18 has been already completed at the time point ($t_1$). The tip end surface of the retired secondary pressurization pin 18 is present within the through-hole 12 as shown by the double-dot chain line in FIG. 1 and as depicted in FIG. 3 (See line $B_3$ in FIG. 4), hence molten metal 32 entered in the through-hole 12 following the retreat of the secondary pressurization pin 18 would be quickly solidified and integrated with the casting fin 30, and the thus formed lumpy body would fill the opening portion of the through-hole 12.

After completion of filling molten metal, as soon as possible the secondary pressurization pin 18 is moved by the operation of the secondary pressurization hydraulic cylinder 24, and secondary pressurization is commenced as a result of the tip end of the same pin 18 being pushed into the molten metal filled in the cavity 14 (the time point ($t_2$); curve C in FIG. 4). The secondary pressurization pin 18 would advance into the cavity 14 beyond the initial position shown in FIGS. 1 and 2 (See curve $B_4$ in FIG. 4), and the aforementioned lumpy body is pushed into the molten metal that is filled in the cavity 14 and being solidified. It is to be noted that the time difference ($t_2-t_1$) between the time point ($t_2$) and the time point ($t_1$) is, for instance, 0.4–0.8 seconds.

Then, after a predetermined period (for example, 4–6 seconds) retreat of the secondary pressusization pin 18 is commenced (the time point ($t_3$); curve $B_5$ in FIG. 4), and the secondary pressurization pressure is also lowered (curve $C_1$ in FIG. 4). After the secondary pressurization pin 18 has begun to retreat, due to a slide resistance in the proximity of the tip end of the pin, a gap space begins to be formed between the secondary pressurization pin 18 and the piston rod 26, and soon the state shown in FIG. 1 is established.

As described in detail above, in the illustrated embodiment, since the secondary pressurization pin 18 and the piston rod 26 are connected by means of the joint cylinder 22 in such manner that when the secondary pressurization pin 18 is pushed into the molten metal filling the cavity 14 the base portion 20 of the secondary pressurization 18 may butt against the tip end of the pisiton rod 26, and when the secondary pressurization pin 18 is retreated in the through-hole 12 a small gap distance (L) may be produced between the base portion 20 of the secondary pressurization pin 18 and the tip end of the piston rod 26; the method according to the present invention characterized in that after commencement of filling of molten metal in a cavity a secondary pressurization pin placed at an initial set position is once retreated and then it is made to advance to be pushed into molten metal, can be easily practiced without making use of a special control system, and generation of a wedge effect caused by the casting fin 30 can be prevented.

It is to be noted that while the initial set positon of the secondary pressurization pin 18 was determined at such position that a part of the tip end of the secondary pressurization pin 18 may project into the cavity in the above-described embodiment, it could be determined at such position that the secondary pressurization pin 18 may be perfectly accommodated within the through-hole 12, and even in such case, it is quite similar to the aforementioned embodiment that after commencement of filling of molten metal the secondary pressurization pin is once retreated.

As will be apparent from the above description, a secondary pressurization casting method characterized in that after commencement of filling of molten metal in a cavity a secondary pressurization pin placed at an initial set position is once retreated and subsequently it is made to advance to pressusize the molten metal, has been proposed.

According to this method, an annular casting fin produced around the outer circumference of the tip end of a secondary pressurization pin during the period when molten metal is injected into and filled in a cavity, can be pushed in jointly with the molten metal subsequently entered into the inside of the casting fin, solidified and integrated therewith, by the secondary pressurizaition pin. Accordingly, it would never occur that a casting fin prevents the movement of the secondary pressurization pin due to a wedge effect, hence a durability of the secondary pressurization pin is also improved, and scheduled secondary pressurization can be surely executed.

What is claimed is:

1. A secondary pressurization casting method, in which molten metal is injected into and filled in a cavity of a mold and then a secondary pressurizing force is exerted upon the filled molten metal by making a secondary pressurization pin advance within a through-hole formed in the wall of the mold; characterized in that after commencement of filling of the molten metal in the cavity, retreating said secondary pressurization pin from an initial set position, and subsequently advancing said secondary pressurization pin to pressurize the molten metal.

2. A secondary pressurization casting method as claimed in claim 1, wherein the initial set position of the secondary pressurization pin is the position where the tip end of said secondary pressurization pin projects into the cavity.

3. A secondary pressurization casting method as claimed in claim 1, wherein the initial set position of the secondary pressurization pin is the position where said secondary pressurization pin is perfectly accommodated within the through-hole.

4. A secondary pressurization casting method as claimed in claim 1, 2 or 3, wherein the secondary pressurization pin is driven by a piston rod of a hydraulic cylinder.

5. A secondary pressurization casting method as claimed in claim 4, wherein when the secondary pressurization pin is placed at the initial set position, a predetermined gap space is formed between the mutually opposed end surfaces of said secondary pressurization pin and said piston rod for allowing retreat of said secondary pressurization pin.

* * * * *